US005371319A

United States Patent [19]

Sato

[11] Patent Number: 5,371,319

[45] Date of Patent: Dec. 6, 1994

[54] KEY ASSIGNER FOR AN ELECTRONIC MUSICAL INSTRUMENT

[75] Inventor: Yasushi Sato, Shizuoka, Japan

[73] Assignee: Kabushiki Kaisha Kawai Gakki Seisakusho, Japan

[21] Appl. No.: 108,314

[22] Filed: Aug. 18, 1993

[30] Foreign Application Priority Data

Aug. 27, 1992 [JP] Japan ..... 4-250430

[51] Int. Cl.[5] ..... G10H 1/06

[52] U.S. Cl. ..... 84/622; 84/692; 84/DIG. 8

[58] Field of Search ..... 84/653, 692, DIG. 8, 84/659, 663, 615, 622, 625, 718

[56] References Cited

U.S. PATENT DOCUMENTS 5,221,803 6/1993 Izumisawa et al. ..... 84/653

*Primary Examiner*—Stanley J. Witkowski

*Attorney, Agent, or Firm*—Andrus, Sceales, Starke & Sawall

[57] ABSTRACT

A key assigner, for an electronic musical instrument that has a plurality of oscillators and that employs for the production of a specific timbre only the number of oscillators that is actually required. The key assigner comprises a control for, upon reception of a tone-ON command, assigning timbre generation to the oscillators by control unit, each of which includes the maximum number of oscillators required for timbre generation. Once timbre generation assignments to all the control units have been effected, and a tone-ON command for a timbre that requires fewer oscillators than compose each of the control units is received, the key assignor assigns the timbre generation to an oscillator, of one of the control units, to which timbre generation assignment has not previously been made.

3 Claims, 21 Drawing Sheets

| | FIRST BYTE | SECOND BYTE | THIRD BYTE | FOURTH BYTE |
|---|---|---|---|---|
| NO EVENT | 0 0 | UNDEFINED | UNDEFINED | UNDEFINED |
| KEY ON | 0 1 | KEY NUMBER | TOUCH DATA | TIMBRE NUMBER |
| KEY OFF | 0 2 | KEY NUMBER | OFF TOUCH DATA | TIMBRE NUMBER |
| TIMBRE CHANGE | 0 3 | UNDEFINED | TIMBRE BANK | TIMBRE NUMBER |

FIG. 17

| UPPER ADDRESS ↑ | |
|---|---|
| | TONE INTERVAL OFFSET (LOWER) |
| | TONE INTERVAL OFFSET (UPPER) |
| | TOUCH COEFFICIENT |
| | ASYMPTOTIC SPEED OF ENVELOPE (SP) |
| | TARGET VALUE OF ENVELOPE (L) |
| | WAVEFORM LOOP END ADDRESS (LE) |
| | WAVEFORM LOOP TOP ADDRESS (LT) |
| | WAVEFORM READ START ADDRESS (SA) |

FIG. 18

| | |
|---|---|
| ↑ | OFFSET OF TONE INTERVAL OFFSET (LOWER) FOR EACH TONE RANGE |
| UPPER | OFFSET OF TONE INTERVAL OFFSET (UPPER) FOR EACH TONE RANGE |
| | OFFSET OF TOUCH COEFFICIENT FOR EACH TONE RANGE |
| | OFFSET OF ENVELOPE ASYMPTOTIC SPEED FOR EACH TONE RANGE |
| ADDRESS | OFFSET OF ENVELOPE TARGET VALUE FOR EACH TONE RANGE |
| | OFFSET OF WAVEFORM LOOP END ADDRESS FOR EACH TONE RANGE |
| | OFFSET OF WAVEFORM LOOP TOP ADDRESS FOR EACH TONE RANGE |
| | OFFSET OF WAVEFORM READ START ADDRESS FOR EACH TONE RANGE |

FIG. 19

(*: TONE-ON STATE)

(1) RESET

| | | |
|---|---|---|
| TG1 | TG0 | ←POINTER |
| TG3 | TG2 | |
| TG5 | TG4 | |
| TG7 | TG6 | |

(2) TWO-SOURCE TIMBRE ASSIGNMENT

| | | |
|---|---|---|
| *TG1 | *TG0 | |
| TG3 | TG2 | ←POINTER |
| TG5 | TG4 | |
| TG7 | TG6 | |

(3) TOW-SOURCE TIMBRE ASSIGNMENT

| | | |
|---|---|---|
| *TG1 | *TG0 | |
| *TG3 | *TG2 | |
| TG5 | TG4 | ←POINTER |
| TG7 | TG6 | |

(4) ONE-SOURCE TIMBRE ASSIGNMENT

| | | |
|---|---|---|
| *TG1 | *TG0 | |
| *TG3 | *TG2 | |
| TG5 | *TG4 | |
| TG7 | TG6 | ←POINTER |

(5) TWO-SOURCE TIMBRE ASSIGNMENT

| | | |
|---|---|---|
| *TG1 | *TG0 | ←POINTER |
| *TG3 | *TG2 | |
| TG5 | *TG4 | |
| *TG7 | *TG6 | |

(6) ONE-SOURCE TIMBRE ASSIGNMENT

① EMPTY OSCILLATOR SEARCH

| | | | |
|---|---|---|---|
| | *TG1 | *TG0 | ←POINTER |
| | *TG3 | *TG2 | |
| → | TG5 | *TG4 | |
| | *TG7 | *TG6 | |

⇩

② SORT

| | | | |
|---|---|---|---|
| | TG5 | *TG4 | |
| | *TG1 | *TG0 | |
| → | *TG3 | *TG2 | |
| | *TG7 | *TG6 | |

⇩

③ TONE-ON ASSIGNMENT

| | | |
|---|---|---|
| *TG5 | *TG4 | |
| *TG1 | *TG0 | ←POINTER |
| *TG3 | *TG2 | |
| *TG7 | *TG6 | |

FIG. 20

(*: TONE-ON STATE)

(7) TWO-SOURCE TIMBRE ASSIGNMENT

| | | |
|---|---|---|
| *TG5 | *TG4 | |
| *TG1 | *TG0 | |
| *TG3 | *TG2 | ←POINTER |
| *TG7 | *TG6 | |

(8) ALL TONE PRODUCTION COMPLETED

| | | |
|---|---|---|
| TG5 | TG4 | |
| TG1 | TG0 | |
| TG3 | TG2 | ←POINTER |
| TG7 | TG6 | |

(9) FOUR ONE-SOURCE TIMBRES ASSIGNED

| | | |
|---|---|---|
| TG5 | *TG4 | |
| TG1 | *TG0 | |
| TG3 | *TG2 | ←POINTER |
| TG7 | *TG6 | |

(10) TWO-SOURCE TIMBRE ASSIGNMENT

| | | |
|---|---|---|
| TG5 | *TG4 | |
| TG1 | *TG0 | |
| *TG3 | *TG2 | |
| TG7 | *TG6 | ←POINTER |

(11) ONE-SOURCE TIMBRE ASSIGNMENT

① EMPTY OSCILLATOR SEARCH

| | | | |
|---|---|---|---|
| | TG5 | *TG4 | |
| | TG1 | *TG0 | |
| | *TG3 | *TG2 | |
| → | TG7 | *TG6 | ←POINTER |

⇩

② TONE-ON ASSIGNMENT

| | | |
|---|---|---|
| TG5 | *TG4 | ←POINTER |
| TG1 | *TG0 | |
| *TG3 | *TG2 | |
| *TG7 | *TG6 | |

FIG. 21

KEY ASSIGNER FOR AN ELECTRONIC MUSICAL INSTRUMENT

BACKGROUND OF THE INVENTION

1. Field of the Invention

The present invention relates to a key assigner, for an electronic musical instrument, that assigns tone generation to a predetermined oscillator upon the reception of a tone-ON command from a keyboard or an external device.

Tone generators for recent electronic musical instruments have a plurality of oscillators, and drive the oscillators, which are combined as needed, to enable the simultaneous production of a plurality of musical tones.

A timbre for tone production is obtained by providing timbre data to an oscillator. However, as the effect of a timbre that is produced using a single oscillator is limited, and as a timbre that has a desired quality cannot at times be thus obtained, a tone generator has been developed, and is in current practical use, that simultaneously drives a plurality of oscillators to generate a desired timbre.

In an electronic musical instrument that incorporates such a tone generator, tone production often involves the employment both of timbres generated by a single oscillator (hereafter referred to as "one-source timbres") and of timbres generated by a plurality of oscillators (hereafter referred to as "multi-source timbres").

As the number of multi-source timbres increases, the number of musical tones that can be simultaneously produced is correspondingly reduced. A desirable key assigner for an electronic musical instrument, therefore, is one that can efficiently employ a limited number of oscillators to maximize the number of musical tones that can be simultaneously produced.

2. Description of the Related Art

Conventionally, those electronic musical instruments that can process multi-source timbres employ a constant number of oscillators to produce the multi-source timbre. An electronic musical instrument having eight oscillators, for example, constantly employs two oscillators to produce one timbre.

Therefore, when production of a timbre is required, two oscillators must always be allocated even when only a single oscillator would suffice, and the total number of musical tones that can be simultaneously produced by the electronic musical instrument is reduced.

More specifically, even though the generation of a timbre A requires two oscillators but the production of a timbre B requires only one, the subject electronic musical instrument will assign two oscillators for the generation of either timbre. Consequently, the number of musical tones that the electronic musical instrument can simultaneously produce is limited to four.

An electronic musical instrument that can adequately manage multi-source timbres assigns timbre generation tasks to individual oscillators. Thus, when two oscillators are required for generation of a timbre, two oscillator assignments are performed.

Accordingly, when many one-source timbres are generated, the number of musical tones that can be simultaneously produced increases. Thus, in the above example, when the generated timbres are all of type timbre B, the number of musical tones that can be simultaneously produced is eight.

Since, however, for the generation of a multi-source timbre, individual assignment processing for multiple oscillators is required, the time lapse between the reception of a tone-ON command and the actual tone production by all the oscillators is extended compared to that for the generation of a one-source timbre.

SUMMARY OF THE INVENTION

It is therefore an object of the present invention to provide a key assigner, for an electronic musical instrument, that can efficiently employ a limited number of oscillators to maximize the number of musical tones that can be simultaneously produced, and to minimize the time lapse between the reception of a tone-ON command and the termination of tone production.

A key assigner according to the present invention, for an electronic musical instrument that has a plurality of oscillators and that employs for the generation of a specific timbre only the number of oscillators that is actually required, comprises control means for, upon reception of a tone-ON command, assigning timbre generation to the oscillators by control unit, each of which includes the maximum number of oscillators required for timbre generation, and for, once timbre generation assignments to all the control units have been effected, and a tone-ON command for the generation of a timbre that requires fewer oscillators than compose each of the control units is received, assigning said timbre generation to an oscillator, of one of the control units, to which tone assignment has not previously been made.

According to the present invention, a control unit is defined as the maximum number of oscillators that may be required for the generation of a timbre. During oscillator task assigning, as long as there is one control unit for which no timbre generation assignment has been effected for either oscillator, sequential control unit assignment of timbre generation to oscillators is performed, regardless of timbre generation requirements, i.e., the number of oscillators required. Once oscillator task assignments have been effected for all the control units and a tone-ON command for a timbre that requires fewer oscillators than are allocated to a control unit is received, the control units are examined to determine whether included in any control unit there is an oscillator that has not received a task assignment. If one is found, a timbre generation task is assigned to that oscillator.

Therefore, since timbre generation that requires the same number of oscillators as is allocated to a control unit can be quickly assigned, and as timbre generation that requires fewer oscillators than are allocated to a control unit can be assigned to an unoccupied oscillator included in one of the control units, the oscillators can be efficiently employed and the number of musical tones that can be simultaneously produced can be maximized.

BRIEF DESCRIPTION OF THE DRAWINGS

FIG. 17 is a diagram for explaining an example of event data according to the embodiment of the present invention;

FIG. 18 is a diagram showing an example of common data according to the embodiment of the present invention;

FIG. 19 is a diagram showing an example of delta data according to the embodiment of the present invention;

FIG. 20 is a diagram for explaining processing of an assigner according to the embodiment of the present invention; and FIG. 21 is a diagram for explaining processing of an assigner according to the embodiment of the present invention.

DETAILED DESCRIPTION OF THE PREFERRED EMBODIMENT

The preferred embodiment of the present invention will now be described while referring to the accompanying drawings. To simplify the explanation, it should be noted that a tone generator described in the embodiment of the present invention has eight oscillators. However, the number of oscillators that can be provided is not limited and may be increased or decreased in consonance with the specifications established for an electronic musical instrument.

It should also be noted that according to the present invention two oscillators are driven simultaneously to produce a specific timbre (hereafter referred to as "two-source timbre").

Figure 1:
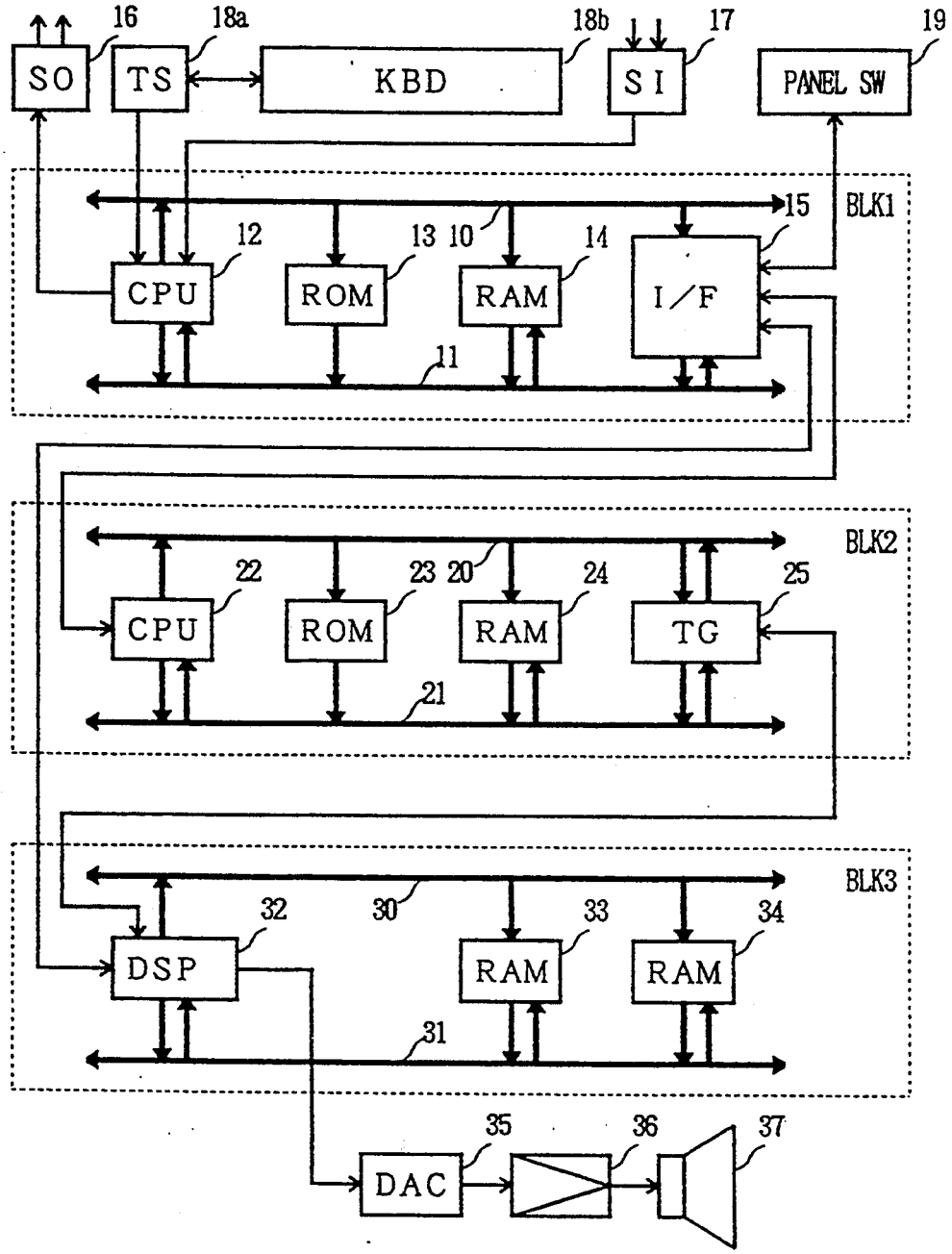
FIG. 1 is a block diagram illustrating the arrangement of one embodiment of an electronic musical instrument wherein a key assigner of the present invention is employed.

FIG. 1 is a schematic block diagram showing the arrangement of an electronic musical instrument wherein a key assigner of the present invention is employed. The electronic musical instrument is essentially divided into three blocks, BLK1, BLK2 and BLK3.

Block BLK1 primarily controls data input and output by a keyboard, panel switches, and an external device. Block BLK2 performs key assignment processing and timbre control that are the main feature of the present invention. Block BLK3 mainly performs acoustic processing and related tone production processing.

In block BLK1, a central processing unit (CPU) 12, a read only memory (ROM) 13, a random access memory (RAM) 14 and an interface circuit (I/F) 15 are mutually connected via an address bus 10 and a data bus 11.

A serial output device (SO) 16, a serial input device (SI) 17 and a touch sensor (TS) 18*a* are connected to the CPU 12. A keyboard (KBD) 18*b* is connected to the touch sensor 18*a*.

Panel switches (panel SW) 19 are connected to the interface circuit (I/F) 15. A CPU 22, in block BLK2, and a digital signal processor (DSP) 32, in block BLK 3, are also connected to the interface circuit (I/F) 15.

The CPU 12 controls the individual sections in block BLK1 by executing a control program that is stored in the ROM 13. For example, the CPU 12 converts play data, which is received from the touch sensor 18*a*, the panel switches 19 or the serial input device 17, into a tone-ON command, a tone-OFF command, or a timbre change command and transmits the converted data to the CPU 22 via the interface circuit 15.

The touch sensor 18*a* , which is connected to the CPU 12, relays data from the keyboard 18*b* to the CPU 12. The keyboard 18*b* is a well known one that has a plurality of keys that are individually equipped with key switches that open and close in response to key depression and key release.

More specifically, the touch sensor 18*a* transmits a scan signal to the keyboard 18*b*. In response to the scan signal, the keyboard 18*b* returns to the touch sensor 18*a* a signal that indicates the ON/OFF state of a key switch. The touch sensor 18*a* employs the signal, which it receives from the keyboard 18*b* and which indicates the ON/OFF state of the key switch, to produce key number data for the depressed or released key and touch data that indicate the speed of key depression or key release, and sends the data to the CPU 12.

The data transmission from the touch sensor 18*a* to the CPU 12 is initiated when the touch sensor 18*a* triggers an interrupt to signal that an event has occurred on the keyboard 18*b*.

The serial output device 16, which is also connected to the CPU 12, outputs to an external device play data that are produced by the electronic musical instrument. Play data that conform to MIDI standards, for example, are output by the serial output device 16.

Conversely, the serial input device 17, which is connected to the CPU 12, inputs to the electronic musical instrument play data that are generated by an external device. Play data that conform to MIDI standards, for example, are input by the serial input device 17.

The data transmission from the serial input device 17 to the CPU 12 is initiated when the serial input device 17 triggers an interrupt to signal the CPU 12 that play data have been received.

In the ROM 13, in addition to the above described control program for the CPU 12, are stored various datum constants used by the CPU 12.

In the RAM 14, various data that the CPU 12 handles are stored temporarily, and various registers, counters and flags, etc., for the control of the electronic musical instrument, are defined.

The interface circuit 15 exchanges data with the panel switch 19, and also controls data exchange between block BLK 1 and the other blocks, BLK2 and BLK3. A memory mapped I/O port, for example, may be employed as the interface circuit 15.

The panel switches 19, connected to the interface circuit 15, include various operation terminals, which control the electronic musical instrument, and switches that are activated in consonance with signals from the operation terminals. These switches are a timbre select switch, a rhythm select switch, a volume switch, an audible effect switch, etc.

The interface circuit 15 transmits a scan signal to the panel switches 19. In response to the scan signal, the panel switches 19 return to the interface circuit 15 a signal that indicates a switch ON/OFF state. The interface circuit 15 sends the switch ON/OFF state signal that it receives from the panel switches 19 to the CPU 12

The data transmission from the interface circuit 15 to the CPU 12 is initiated when the interface 15 triggers an interrupt to signal the CPU 12 that an event has occurred at the panel switches 19.

In block BLK2 the CPU 22, a ROM 23, a RAM 24, and a tone generator (TG) 25 are mutually connected via an address bus 20 and a data bus 21.

The address bus 20 and the data bus 21 are used by the CPU 22 and the tone generator 25 in a time-sharing manner.

Figure 6:
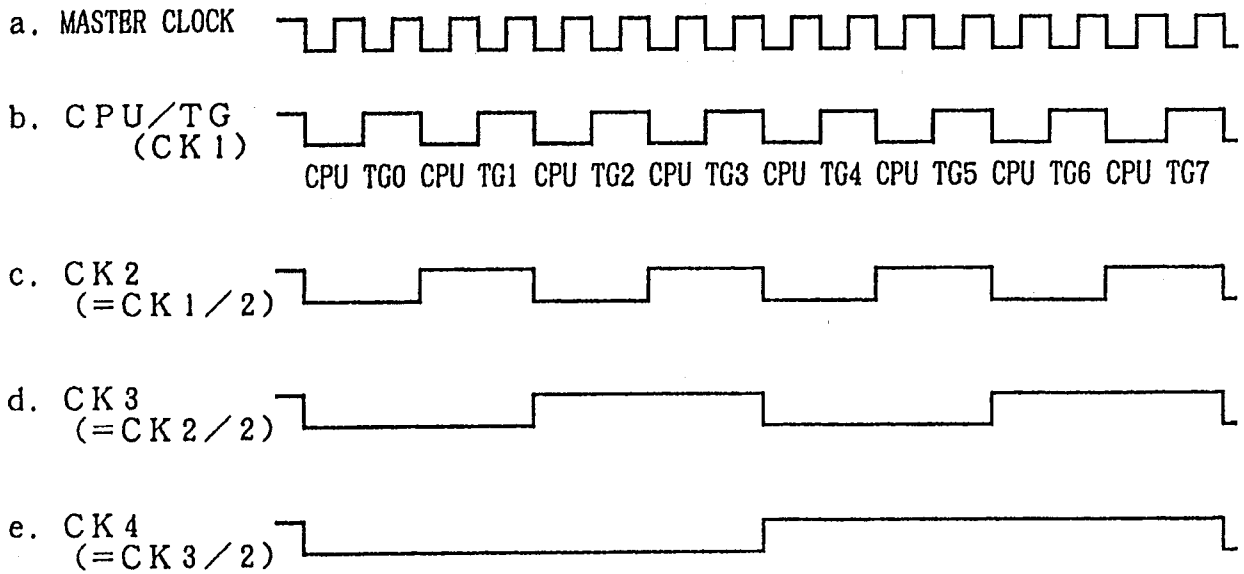
FIG. 6 is a diagram for explaining the concept of a clock according to the embodiment of the present invention.

The concept of a clock that is used in block BLK2 will now be explained while referring to FIG. 6.

A master clock that is provided by a generator (not shown) is a constant cycle pulse signal, as shown in FIG. 6A. The master clock is frequency-divided by two to obtain clock CK1 (CPU/TG), as shown in FIG. 6B. The CPU 22 and the tone generator 25 each use half a cycle of clock CK1. (The CPU 11 uses the first half of a cycle and the tone generator 25 uses the second half).

Since the tone generator 25 in the embodiment has eight oscillators, to access the oscillators (TG0 to TG7) equally, as shown in FIGS. 6C to 6E there are also clock CK2, which is obtained by frequency-dividing clock CK1 by two; clock CK3, which is obtained by frequency-dividing clock CK2 by two; and clock CK4, which is obtained by frequency-dividing clock CK3 by two.

With clocks CK1 through CK4 (hereafter referred to as "time-shared channel signal TSCH"), the CPU 22 or one of the oscillators TG0 to TG7 is alternately selected.

The address bus 20 and the data bus 21 are therefore time-shared and used for every time slot, as is specified by the time-shared channel signal TSCH.

The CPU 22 controls the individual sections of block BLK2 by executing a control program that is stored in the ROM 23. The CPU 22 receives data, such as a tone-0N command, a tone-OFF command or a timbre change command, from the CPU 12 in block BLK 1 via the interface circuit 15, and employs the received data to control the tone generator 25.

Besides the control program for the CPU 22, various fixed data that the CPU 22 uses are stored in the ROM 23 as described above. Tone wave data that are read by an internal oscillator of the tone generator 25 are also stored in the ROM 23.

Data that the CPU 22 handles are stored temporarily in the RAM 24, and various registers, counters, flags, etc., for the control of the electronic musical instrument, are defined therein. For example, timbre data, which are required for tone production, and tone wave data, which are read by the internal oscillators of the tone generator 25, are stored in the RAM 24.

The tone generator 25 is a source that includes eight oscillators. More specifically, in response to a tone-0N command from the CPU 22, the tone generator 25 reads tone wave data that are stored in the ROM 23 and sends the data to the digital signal processor 32. Also, in response to a tone-OFF command from the CPU 22, the tone generator 25 terminates the reading of tone wave data that is stored in the ROM 23 and halts the transmission of data to the digital signal processor 32.

In block BLK3, the digital signal processor (DSP) 32, the RAM 33 and the RAM 34 are mutually connected via an address bus 30 and a data bus 31.

The DSP 32 receives a tone signal from the tone generator 25 in block BLK2, adds audible effects to the signal and sends it to a D/A converter (DAC) 35.

In the RAM 33 is stored a program to activate the DSP 32. The program stored in the RAM 33 is transmitted from the CPU 12 in block BLK 1, and is loaded during initialization at power on.

In the RAM 34, tone signal data, sent from the tone generator 25 in block BLK 2, are stored temporarily. The tone signal data stored in the RAM 34 are processed by the DSP 32 to generate audible effects. For example, a reverberation effect is obtained by delaying tone signal data using the RAM 34.

The D/A converter 35, which is connected to the DSP 32, converts a digital tone signal, which is output by the DSP 32, into an analog tone signal. The output of the D/A converter 35 is sent to an amplifier 36.

The amplifier 36 amplifies a received analog tone signal by a predetermined gain and outputs the resultant signal. The output of the amplifier 36 is sent to a loudspeaker 37.

The loudspeaker 37 is a well known one that converts an analog tone signal that is received as an electric signal into an acoustic signal.

The oscillators that constitute the tone generator 25 will now be explained in detail while referring to FIGS. 2 through 5.

Figure 2:
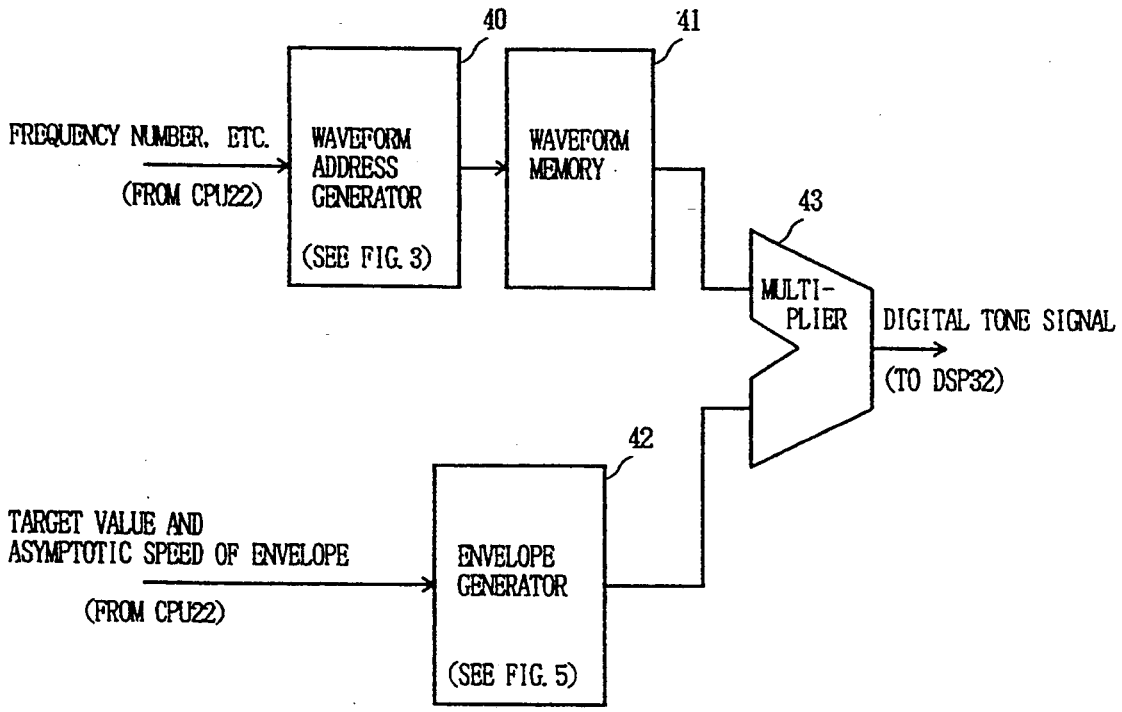
FIG. 2 is a block diagram illustrating the arrangement of an oscillator according to the embodiment of the present invention.

Each of the oscillators includes a waveform address generator 40, a waveform memory 41, an envelope generator 42 and a multiplier 43, as shown in FIG. 2.

The waveform address generator 40 receives from the CPU 22 "frequency numbers", i.e., data that are proportional to tone frequency, and other data, and in consonance with the received data generates a waveform address to read tone wave data. A waveform address output by the waveform address generator 40 is sent to the wave memory 41. The details of the waveform address generator 40 will be given later.

The wave memory 41 is part of the above described ROM 23, where a plurality of types of tone wave data corresponding to timbres and tone ranges are stored. Tone wave data for each timbre is specified as a waveform read start address (SA), a loop top address (LT), and a loop end address (LE), all of which will be described later. The output of the waveform memory 41 is sent to one of the input terminals of the multiplier 43.

The envelope generator 42 employs data, such as a target value and an asymptotic speed for an envelope, that are transmitted by the CPU 22 to produce envelope data to add an envelope to tone wave data. The output of the envelope generator 42 is sent to the other input terminal of the multiplier 43.

The multiplier 43 multiplies tone wave data, which is output by the wave memory 41, by envelope data, which is output by the envelope generator 42, to add an envelope to tone wave data, and outputs the resultant data as a digital tone signal. The digital tone signal is sent to the DSP 32.

Figure 3:
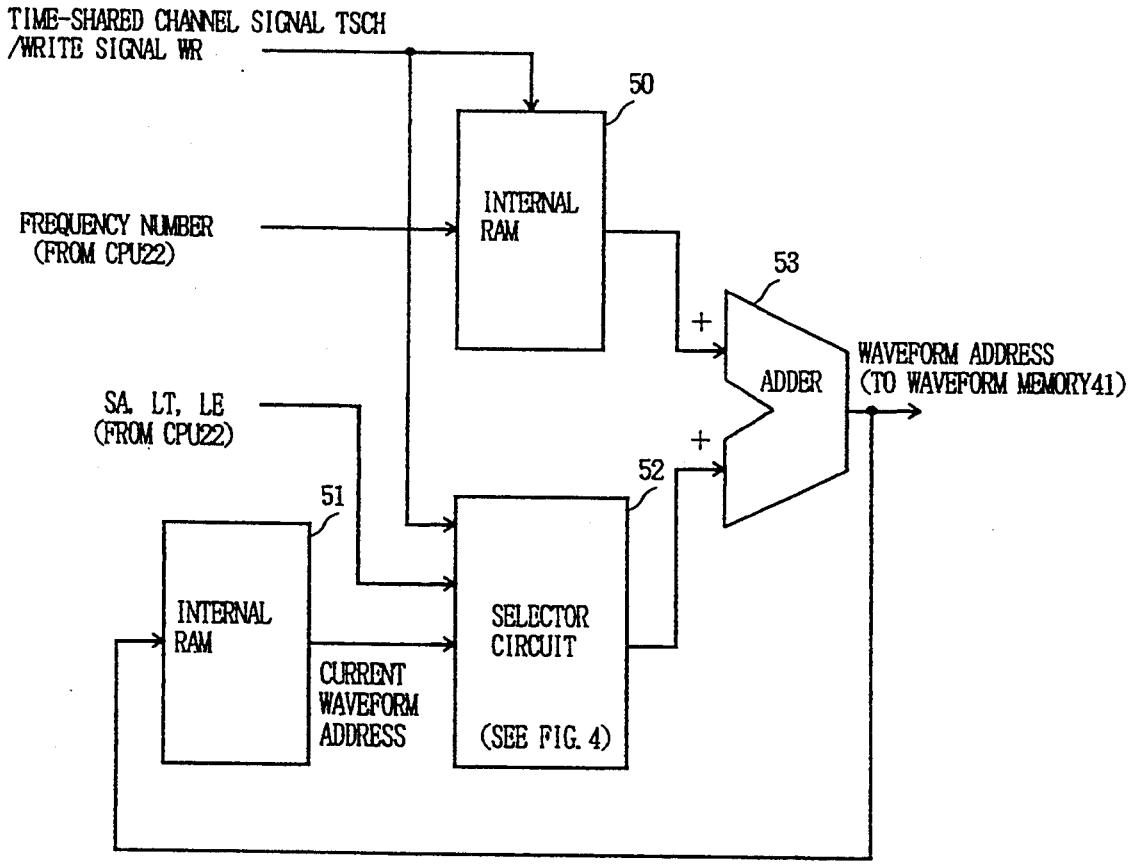
FIG. 3 is a block diagram showing a waveform address generator in FIG. 2.

FIG. 3 shows the detailed arrangement of the waveform address generator 40. The waveform address generator 40 comprises internal RAMs 50 and 51, a selector circuit 52 and an adder 53.

The internal RAM 50 is provided within the tone generator 25, and in consonance with a write signal WR, a frequency number sent from the CPU 22 is stored at a location in the internal RAM 50 that a time-shared channel signal TSCH addresses. In the internal RAM 50, therefore, frequency numbers that correspond to eight oscillators are stored.

The contents of the internal RAM 50 are read by employing the time-shared channel signal TSCH as an address. A read frequency number is then sent to one of the input terminals of an adder 53. As will be described later, it is used as an increase with respect to a read start address (SA) or a loop top address, which are sent to the other input terminal of the adder 53. The amount of this increase determines a frequency for a musical tone to be produced, i.e., a pitch.

The internal RAM 51 is also provided within the tone generator 25. The output of the adder 53, i.e., a current waveform address (CA), is stored in the internal RAM 51 for every calculation cycle. The current waveform address (CA), which is stored in the internal RAM 51, is sent to the selector circuit 52.

The selector circuit 52 selects either the current waveform address (CA) that is output from the internal RAM 51, the waveform read start address (SA), or the loop top address (LT), and outputs the selected address. (A detailed explanation will be given later.) The output of the selector circuit 52 is sent to the other input terminal of the adder 53.

The adder 53 adds the output of the internal RAM 50 to the output of the selector circuit 52. The output of the adder 53 is not only sent to the internal RAM 51 and stored during one calculation cycle, but is also output as a waveform address to the waveform memory 41 (see FIG. 2).

Figure 4:
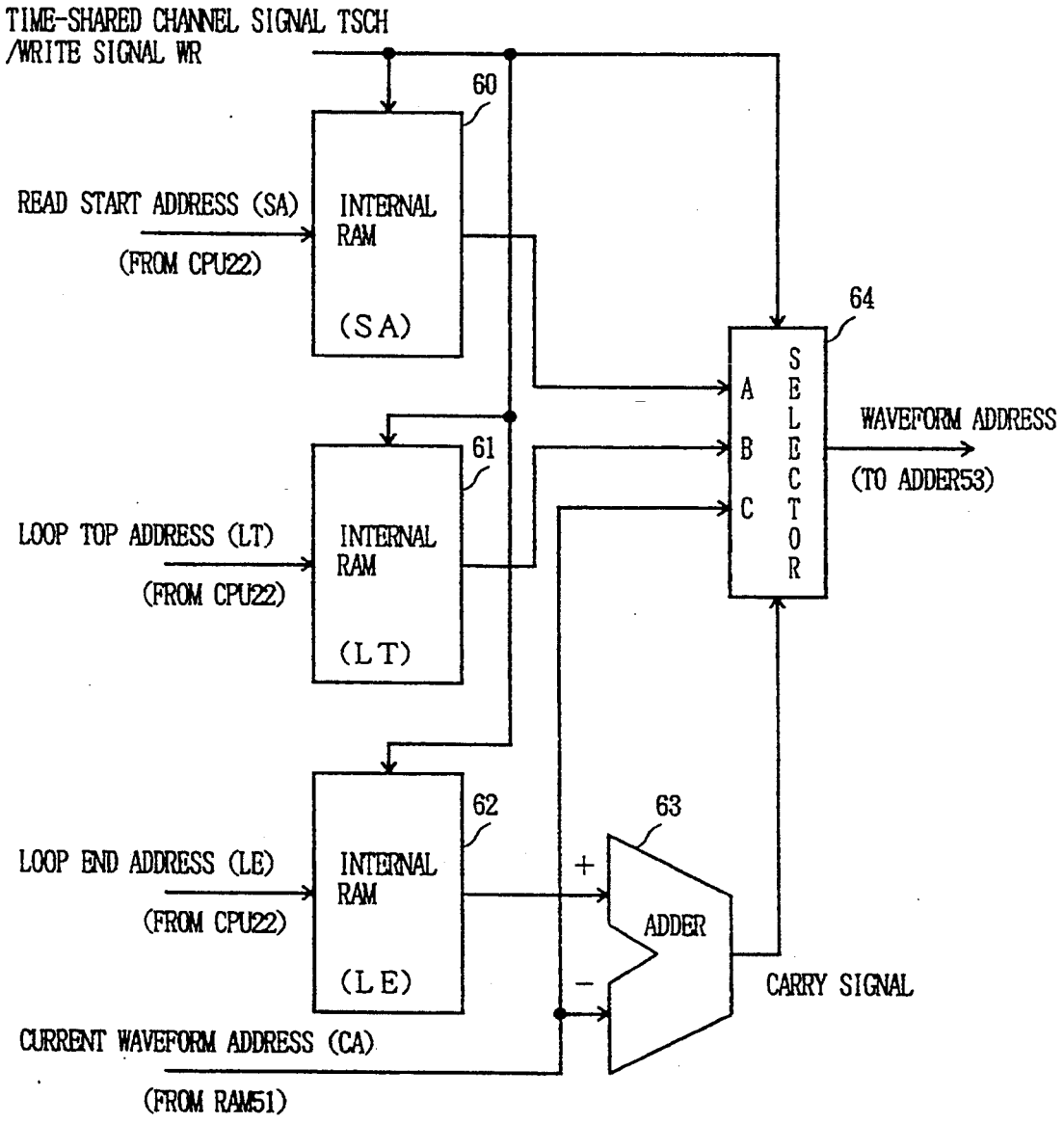
FIG. 4 is a block diagram illustrating the arrangement of a selector in FIG. 3.

The detailed arrangement of the selector circuit 52 is illustrated in FIG. 4. The selector circuit 52 comprises internal RAMs 60, 61 and 62, a selector 64 and an adder 63.

The internal RAM 60 is provided within the tone generator 25. In consonance with a write signal WR, a read start address (SA), which is sent from the CPU 22, is stored at a location in the internal RAM 60 that a time-shared channel signal TSCH addresses. In the internal RAM 60, therefore, read start addresses (SA) that correspond to eight oscillators are stored.

The contents of the internal RAM 60 are read by using the time-shared channel signal TSCH as an address, and a read-out read start address (SA) is supplied to input terminal A of the selector 64.

The internal RAM 61 is provided within the tone generator 25. In consonance with a write signal WR, a loop top address (LT), which is sent from the CPU 22, is stored at a location in the internal RAM 61 that a time-shared channel signal TSCH addresses. In the internal RAM 61, therefore, loop top addresses (LT) that correspond to eight oscillators are stored.

The contents of the internal RAM 61 are read using the time-shared channel signal TSCH as an address, and a read-out loop top address (LT) is supplied to input terminal B of the selector 64.

The internal RAM 62 is provided within the tone generator 25. In consonance with a write signal WR, a loop end address (LE), which is sent from the CPU 22, is stored at a location in the internal RAM 62 that a time-shared channel signal TSCH addresses. In the internal RAM 62, therefore, loop end addresses (LE) that correspond to eight oscillators are stored.

The contents of the internal RAM 62 are read using the time-shared channel signal TSCH as an address, and a read-out loop end address (SA) is supplied to input terminal C of the selector 64.

The adder 63 subtracts a current waveform address (CA) from a loop end address (LE) that is output from the internal RAM 62. By this process, whether a current waveform address (CA) has exceeded a loop end address (LE) is determined.

More specifically, during the process wherein a current waveform address (CA) is subtracted from a loop end address (LE), if subtraction is possible ($LE \geqq CA$), a carry signal CRY becomes active; whereas if subtraction is impossible ($LE < CA$), the carry signal CRY becomes inactive. The carry signal CRY output by the adder 63 is sent to the selector 64 to be used for input selection.

The selector 64 has three input terminals and one output terminal. It selects specified data in consonance with a write signal WR and a carry signal CRY, and outputs the selected data. In other words, when a write signal WR becomes active, the selector 64 selects input terminal A, and outputs the contents of the internal RAM 60, i.e., a read start address (SA).

When a carry signal CRY becomes active, however, input terminal C is selected, and the contents of the internal RAM 51, i.e., a current waveform address (CA) is sent thereto. In other cases, input terminal B is selected to receive the contents of the internal RAM 61, i.e., a loop top address (LT).

Figure 5:
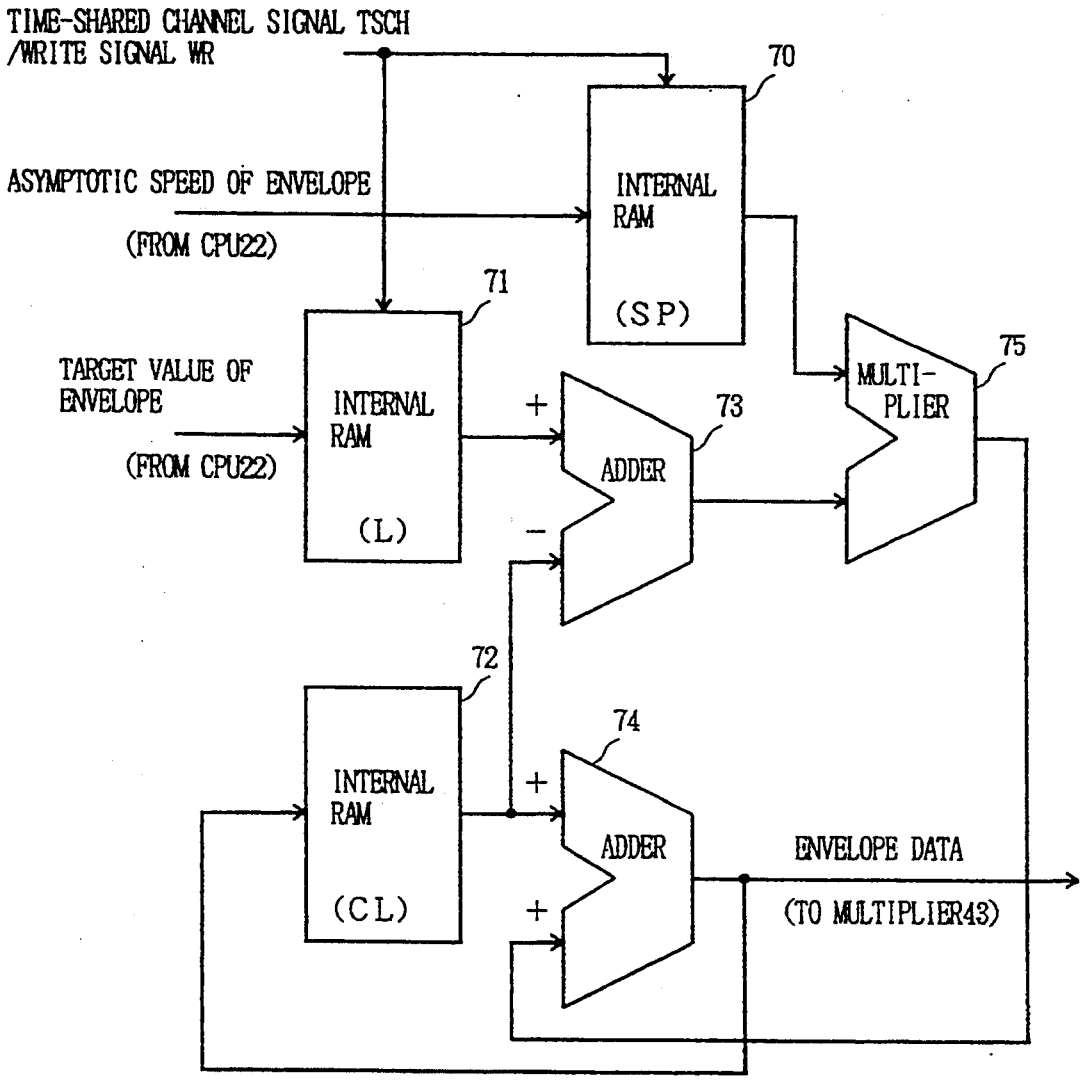
FIG. 5 is a block diagram showing the arrangement of an envelope generator in FIG. 2.

The envelope generator 42 shown in FIG. 2 will now be explained in detail while referring to FIG. 5.

An internal RAM 70 is provided within the tone generator 25. In consonance with a write signal WR, an envelope asymptotic speed (SP), which is sent from the CPU 22, is stored at a location in the internal RAM 70 that a time-shared channel signal TSCH addresses. In the internal RAM 70, therefore, envelope asymptotic speeds (SP) that correspond to eight oscillators are stored.

The contents of the internal RAM 70 are read by using the time-shared channel signal TSCH as an address, and a read-out envelope asymptotic speed (SP) is supplied to one of the input terminals of a multiplier 75.

An internal RAM 71 is provided within the tone generator 25. In consonance with a write signal WR, an envelope target value (L), which is sent from the CPU 22, is stored at a location in the internal RAM 71 that a time-shared channel signal TSCH addresses. In the internal RAM 71, therefore, envelope target values (L) that correspond to eight oscillators are stored.

The contents of the internal RAM 71 are read using the time-shared channel signal TSCH as an address, and a read-out envelope target value (L) is supplied to one of the input terminals of an adder 73.

An internal RAM 72 is provided within the tone generator 25, and an envelope current value (CL) that is sent from the multiplier 75 is accumulatively stored. The output of the internal RAM 72 is sent to the other input terminal of the adder 73.

The adder 73 subtracts the output of the internal RAM 72 from the output of the internal RAM 71. In other words, the adder 73 subtracts the current value (CL) of an envelope from the target value (L) of an envelope to obtain the difference. The output of the adder 73 is sent to the other input terminal of the multiplier 75.

The multiplier 75 multiplies an envelope asymptotic speed (SP), which is output from the internal RAM 70, by a difference value, which is output by the adder 73. The output of the multiplier 75 is sent to the other input terminal of the adder 74 and is employed as a displacement value with respect to the envelope current value (CL).

The adder 74, as described above, adds the current value (CL) of an envelope, which is output from the internal RAM 72, to a displacement value, which is output by the multiplier 75, and outputs a resultant value as a new envelope current value (CL). This value is stored in the internal RAM 72 and concurrently sent to the multiplier 43 (see FIG. 2).

In short, the thus structured envelope generator 42 performs the following calculation:

$$CL_{n+1} \rightarrow CL_n + (L - CL_n) \times SP \quad (1);$$

where $CL_n$ is a current value of an envelope, $CL_{n+1}$ is a new envelope value, L is a target value of an envelope, and SP is an envelope asymptotic speed.

As new envelope data are continuously produced by the time slots that are assigned to the individual oscillators, the value of the envelope data gradually approaches the target value.

Processing of the above arranged oscillators will now be explained. In this embodiment, timbre data are classified and stored as common data and delta data, as shown in FIGS. 18 and 19. The common data are employed for all tone ranges. To obtain a two-source timbre, two sets of common data are prepared in this embodiment.

As shown in FIG. 18, common data include a waveform read start address (SA), a loop top address (LT), a loop end address (LE), an envelope target value (L), and an envelope asymptotic speed (SP), all of which are described above, and a touch coefficient and a tone interval offset.

The touch coefficient is employed to change the strength of a key touch response for all the tone ranges. The touch coefficient affects the envelope target value and asymptotic speed, and is employed to strengthen or weaken the key touch response for all depressed keys.

The tone interval offset is employed to slightly shift the frequency of a musical tone to be produced. The tone interval offset affects a frequency number that determines a pitch, and is employed to raise or lower the pitch of all produced musical tone.

The delta data, which are provided for every tone range as shown in FIG. 19, consist of offset data that correspond to the data that constitute the common data. Tone ranges that correspond to the individual types of delta data can be determined arbitrarily.

The common data are added to the delta data, and the resultant data are provided for the tone generator 25. Thus, even for musical tones produced by the same musical instrument, for example, a different timbre can be provided for each tone range.

To produce a musical tone, the timbre data and the frequency number are transmitted to a selected oscillator in the tone generator 25. The selection of an oscillator that is used for tone generation will be described later.

In the oscillator selected in the tone generator 25, as described above, the waveform address generator 40 employs a waveform read start address (SA), a loop top address (LT) and a loop end address (LE) to produce a waveform address. The waveform address generator 40 reads tone wave data from the waveform memory 41 in consonance with the waveform address and sends the data to the multiplier 43.

The envelope generator 42, of the selected oscillator in the tone generator 25, employs a target value (L) and asymptotic speed (SP) of an envelope to produce envelope data, and transmits the data to the multiplier 43, as described above. The multiplier 43 multiplies the received tone wave data by the received envelope data and produces a digital tone signal.

With such an arrangement, the processing performed by the electronic musical instrument concerned, especially the processing of a key assigner, will now be described.

Figure 7:
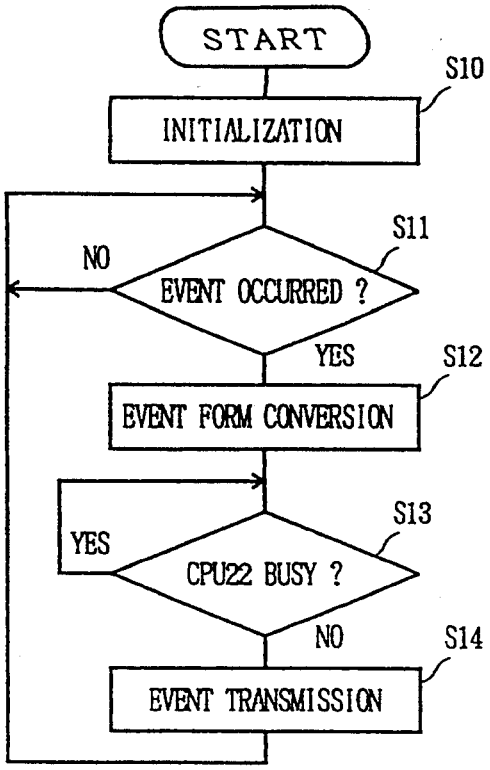
FIG. 7 is a flowchart (main routine) showing the processing performed by a CPU 12 according to the embodiment of the present invention.

FIG. 7 is a flowchart of a main routine showing the processing performed by the CPU 12 in block BLK1. First, at power on, initialization is performed (step S10).

During this process, the initial, internal state of the CPU 12 is set, and registers, counters, flags, etc. that are defined in the RAM 14 are set to their initial states. Also, during the initialization a control program to activate the DSP 32 is transferred to the RAM 33 in block BLK3.

When the initialization is completed, a check is performed to determine whether or not an event has occurred (step S11). This determination is performed by examining an event queue provided in the RAM 14.

The event queue is established by a first-in-first-out (FIFO) memory that is controlled by a write counter ECTR and a read pointer EPTR. In other words, event data is written in under the control of the write counter ECTR, and written event data is read out under the control of the read pointer EPTR.

When the write counter ECTR and the read pointer EPTR match, therefore, the event queue is empty, and it is determined that no event has occurred. When the write counter ECTR and the read pointer EPTR do not match, there are unprocessed event data and it is determined that an event has occurred.

At step S11, program execution loops until it is determined that an event has occurred. When it is determined at step S11 that an event has occurred, an event form conversion is performed (step S12).

During the event form conversion, event data stored in the event queue, as shown in FIG. 17, are converted into a data form that the CPU 22 can handle.

Then, a check is performed to determine whether or not the CPU 22 is busy (step S13). During this process, the status of the CPU 22 is checked to determine whether it is ready to receive event data.

At step S13, program execution loops until it is determined that the CPU 22 is not busy. When it is determined at step S13 that the CPU 22 has been released and is not busy, event transmission is performed. (step S14).

During this process, an interrupt is triggered to notify the CPU 22 that event data are to be transmitted, and the event data fetched from the event queue of the RAM 14 are transmitted to the CPU 22.

Figure 16:
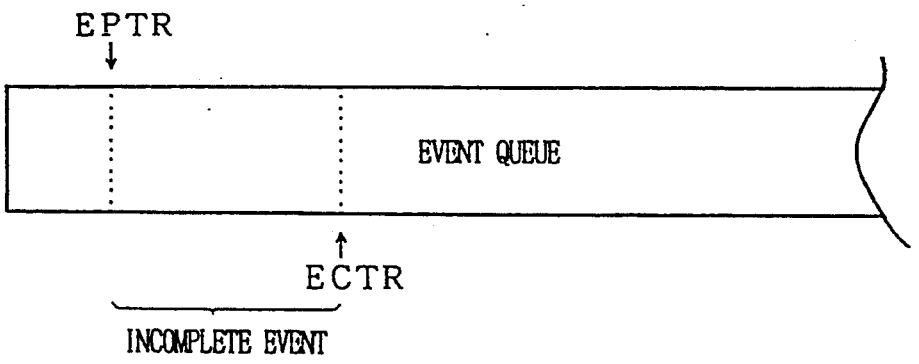
FIG. 16 is a diagram for explaining the structure of an event queue according to the embodiment of the present invention.

The CPU 22 receives the event data by executing an interrupt process (to be described in detail later), and stores the data in the event queue provided in the RAM 24. Since the event queue in the RAM 24 is structured the same as that shown in FIG. 16, no explanation is given.

When the event transmission is completed, program control returns to step S11, and the processing described above is repeated.

In block BLK1, interrupt processing is performed to transmit the states of the keyboard **18*b* and the panel switches 19, and data received from the serial input device 17, to the CPU 12**.

Figure 8:
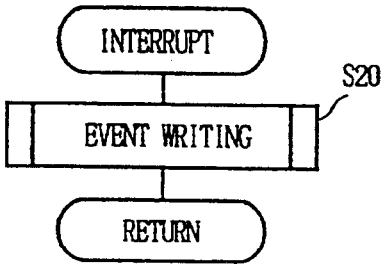
FIG. 8 is a flowchart showing an interrupt service process performed by the CPU 12 according to the embodiment of the present invention.

More specifically, when the keyboard **18*b* or the panel switch 19 is manipulated, or when data is received from the serial input device 17, the interrupt processing routine shown in FIG. 8** is activated.

Figure 11:
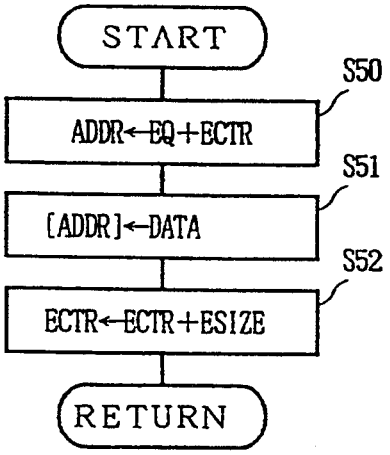
FIG. 11 is a flowchart showing an event write process according to the embodiment of the present invention.

In the interrupt processing routine, event writing is performed (step $20). During the event writing, as shown in FIG. 11, the value of the write counter ECTR is added to a head address EQ in the event queue, and the resultant value is loaded into an address register ADDR (step S50).

Then, employing the contents of the address register ADDR as an address, event data DATA for the event that has triggered the interrupt are written into the event queue (step S51). In FIG. 17 are examples of the event data DATA that correspond to an event for which an interrupt is called.

An event size ESIZE (which differs in consonance with the event types for which an interrupt is called) is added to the contents of the write counter ECTR (step S52). The program control then returns from the event writing routine and the interrupt routine.

When, for example, a key on the keyboard **18*b* is depressed, an interrupt signal indicating that the key has been depressed is sent to the CPU 12, and key-ON data (four-byte data consisting of a key-ON code, a key number, touch data, and a timbre number) are subsequently sent via the touch sensor 18*a* to the CPU 12**. The key-ON data are then written into a four-byte area beginning at an address that is determined by using the contents of the write counter ECTR and the head address EQ of the event queue. The value held by the write counter ECTR is thereafter incremented by four.

Likewise, when, for example, a depressed key on the keyboard **18*b* is released, an interrupt signal indicating that a key has been released is sent to the CPU 12, and key-OFF data (four-byte data consisting of a key-OFF code, a key number, OFF touch data, and a timbre number) are subsequently sent via the touch sensor 18*a* to the CPU 12**. The key-OFF data are written in a four-byte area beginning at an address that is determined by using the contents of the write counter ECTR and the event queue head address EQ. The value held by the write counter ECTR is thereafter incremented by four.

Further, when, for example, a timbre select switch on the panel switches 19 is manipulated, an interrupt signal indicating such a switch manipulation is sent to the CPU 12, and timbre select data (three-byte data consisting of a timbre select code, a timbre bank and a timbre number) are subsequently sent via the interface circuit 15 to the CPU 12. The timbre select data are written in a three-byte area beginning at an address that is determined by using the contents of the write counter ECTR and the event queue head address EQ. The value held by the write counter ECTR is thereafter incremented by three.

Although a detailed explanation is not given here, when data is received from the serial input device 17, it is also written in the event queue in the manner as described above.

Figure 9:
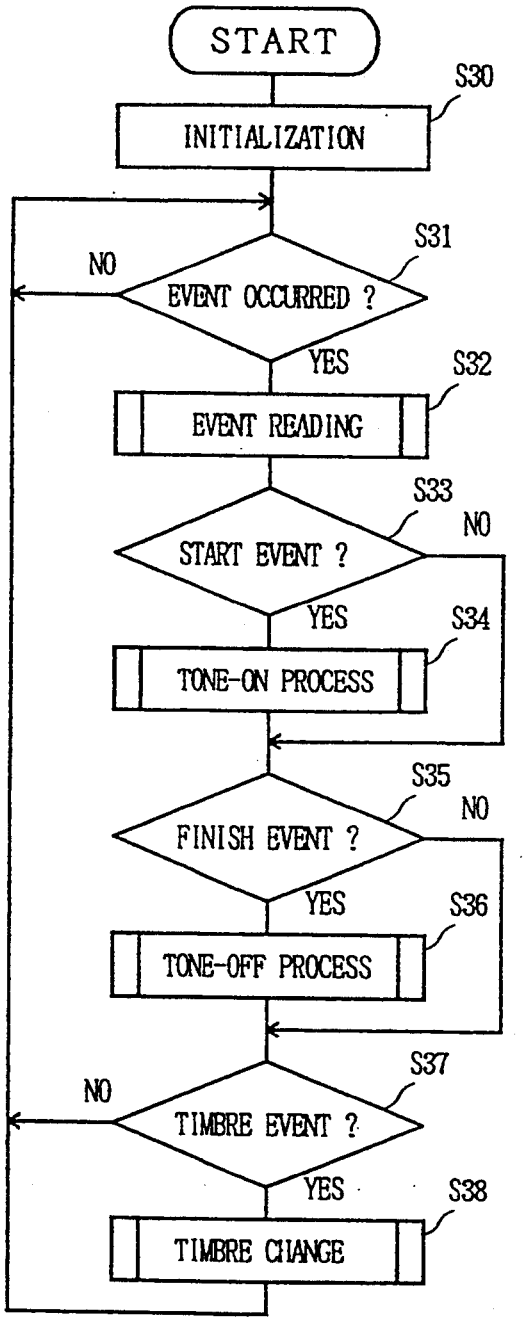
FIG. 9 is a flowchart (main routine) showing the processing performed by a CPU 22 according to the embodiment of the present invention.

The processing for block BLK2 will now be described. FIG. 9 is a flowchart of the main routine executed by the CPU 22 in block BLK2. First, at power on, initialization is performed (step S30).

During this process, the initial, internal state of the CPU 22 is set, and registers, counters, flags, etc., that are defined in the RAM 24 are set to their initial states. Also, the initial, internal state of the tone generator 25 is set to prevent the production of unwanted musical tones.

When the initialization is completed, a check is performed to determine whether or not an event has occurred (step S31). This determination is performed by examining an event queue (not shown) provided in the RAM 24.

At step S31, program control loops until it is determined that an event has occurred. When it is determined at step S31 that an event has occurred, event reading is performed (step S32).

Figure 12:
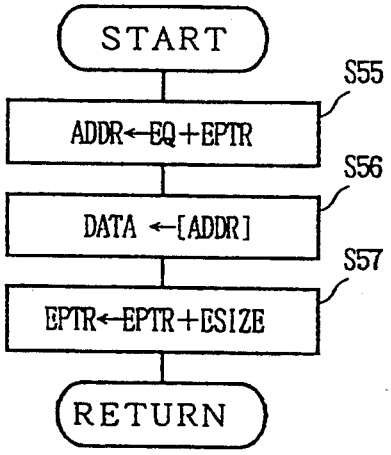
FIG. 12 is a flowchart showing an event read process according to the embodiment of the present invention.

During the event reading process shown in FIG. 12, first, a value held by the read pointer EPTR is added to the event queue head address EQ and the resultant value is loaded into the address register ADDR (step S55).

Then, employing the contents of the address register ADDR as an address, the event data DATA is read from the event queue (step S56).

The event size ESIZE (which is different for each event type) is added to the read pointer EPTR. Program control then returns from the event reading routine to the main routine.

In the main routine, a check is performed to determine whether or not a read event is a start event (step S33). More specifically, a check is performed to determine whether a read event is a tone-ON command, which is issued in response to key depression on the keyboard **18*b*, or key-ON data, which is received from the serial input device 17. When the read event is found to be a start event, a tone-ON process is initiated (step S34**). When it is found that the event is not a start event, the tone-ON process is skipped. The tone-ON process will be described later.

Next, a check is performed to determine whether or not a read event is a finish event (step S35). More specifically, a check is performed to determine whether a read event is a tone-OFF command, which is issued in response to key release on the keyboard **18*b*, or key-OFF data, which are received from the serial input device 17. When the read event is found to be a finish event, a tone-OFF process is initiated (step S36**). When it is found that the event is-not a finish event, the tone-OFF process is skipped. The tone-OFF process will be described later.

Then, a check is performed to determine whether or not a read event is a timbre event (step S37). More specifically, a check is performed to determine whether or not a read event is a timbre change command, which is issued upon receipt of a switch manipulation signal from the panel switches 19, or timbre change data, which are received from the serial input device 17. If the read event is found to be a timbre event, a timbre change process is performed (step S38). Program control then returns to step S31 and the process described above is repeated.

When it is found that the read event is not a timbre event, program control returns to step S31 without performing a timbre change process and the above described process is repeated.

In block BLK2, event data, which are sent by the CPU 12 in block BLK1 (step S14 in FIG. 7), are acquired by the CPU 22 in response to an interrupt.

Figure 10:
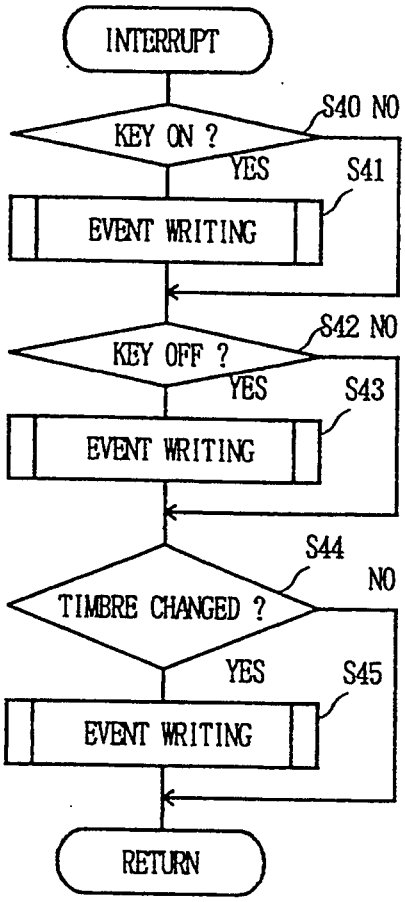
FIG. 10 is a flowchart showing an interrupt service process performed by the CPU 22 according to the embodiment of the present invention.

In other words, when an interrupt occurs to signal that event data are to be transferred from block BLK1, an interrupt routine shown in FIG. 10 is executed.

In the interrupt processing routine, first, a check is performed to determine whether or not received event data are key-ON data (step S40). If the event data are found to be key-ON data, event writing is performed (step S41). Since event writing has previously been explained, no explanation of the procedures will be given here.

If it is found that the received event data are not key-ON data, a check is performed to determine whether or not the event data are key-OFF data (step S42). If the event data are found to be key-OFF data, event writing is performed (step S43) as is described above.

If it is found that the received event data are not key-OFF data, a check is performed to determine whether or not the data are timbre select data (step S44). When the event data are found to be timbre select data, event writing is performed (step S45) as is described above. Program control then returns from the interrupt processing routine.

By performing such an interrupt process, the contents of the event queue, formed in the RAM 14 by the CPU 12, are moved into the RAM 24. The CPU 22 refers to the event queue that is moved into the RAM 24 to determine the occurrence of an event (step S31 in FIG. 9).

Before the tone-ON process, the tone-OFF process, and the timbre change process shown in FIG. 9 are explained, the outline of a key assigner employed in the embodiment will be explained.

A key assigner in this embodiment can perform assignment tasks for both a one-source timbre and a two-source timbre by employing a pointer sorting system that provides pseudo tone-generation priority for a subsequently depressed key. The key assigner in the embodiment performs processing following the schematic rules represented by ① through ④:

① always performs tone assignment when a key depression event has occurred;

② always performs assignment to a tone-OFF channel if it exists;

③ performs assignment to the oldest assigned channel for tone production if no tone-OFF channel exists;

④ always performs two-source timbre assignment to an even number channel and its immediately succeeding channel.

Tone-ON assignment to the oscillators, for example, is controlled by using a pointer that designates a table in the RAM 24 and a specific entry in the table, as shown in FIGS. 20 and 21.

In this table, an oscillator number, held in one byte, is entered for each of the eight oscillators that constitute the tone generator 25. Further, data are stored that indicate whether or not the oscillators that are identified by the oscillator numbers are in a tone-0N state. (In FIGS. 20 and 21, an asterisk, "*" is employed to identify an oscillator that is in a tone-ON state.)

To store data indicating that the oscillators are in the tone-ON state, another table is provided that corresponds to the above described table, or the unused bits of a byte in which an oscillator number is stored are employed.

A pointer, depicted by an arrow in FIGS. 20 and 21, is controlled so that it points to an oscillator pair to be assigned.

Figure 13:
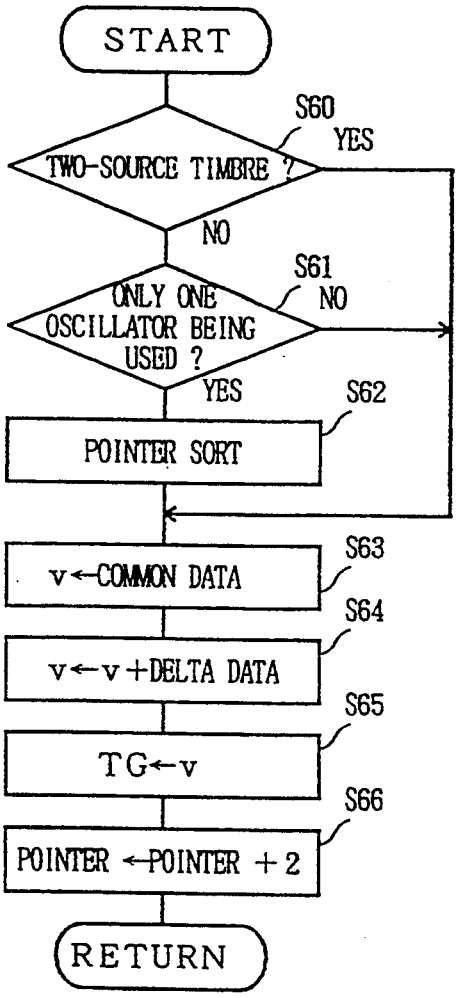
FIG. 13 is a flowchart showing a tone-ON process according to the embodiment of the present invention.

In the tone-ON processing shown in FIG. 13, first, a check is performed to determine whether or not the key-0N data to be executed for tone production is for a two-source timbre (step S60).

When the data is found to be for a two-source timbre, program control branches to step S63 where timbre data is transmitted to the two oscillators that a current pointer designates.

More specifically, common data (see FIG. 18) that correspond to a timbre number, which is included in the key-ON data, are read from the ROM 23 and stored in a register v (step S63). Then, delta data (see FIG. 19) that correspond to a key range, to which a key number included in the key-ON data belongs, are read from the ROM 23 and added to the contents of the register v. The resultant data are then stored in the register v (step S64).

Then, the contents of the register v are sent to the tone generator 25 (step S65). The pointer is incremented by two (step S66), and program control returns from the tone production routine.

As a result, the tone generator 25 produces a musical tone having an assigned timbre, as was previously described. A pitch to be produced is determined by a frequency number that is supplied by the CPU 22 to the tone generator 25.

If, at step S60, it is found that the key-ON data is not for a two-source timbre, it is assumed that the data is for a one-source timbre and a check is performed to determine whether or not only one oscillator of the pair designated by the pointer has an entry that is in use (step S61).

When it is found that neither of the oscillators has an entry that is in use, i.e., both oscillators designated by the pointer are not in use, program control branches to step S63 where data is transferred to one oscillator of the pair designated by the pointer (steps S63 to S65). During this process, a musical tone having a one-source timbre is generated. The other oscillator designated by the pointer is unchanged, and has no tone production assignment.

If, at step S61, only one oscillator of the pair designated by the pointer is found to have an entry that is in use, pointer sorting is performed (step S62). The pointer sorting will now be described while referring to (6) in FIG. 20.

In the pointer sorting process, when an empty oscillator is found by examining the table ("TG5"is empty in FIG. 20(6)), the entry pair that includes the empty oscillator is repositioned to the location that is currently pointed to by the pointer, while data in the currently designated entry pair and intervening data are sequentially shifted down by two bytes. The pointer sorting process is thus terminated.

When the pointer sorting is completed, data transfer is performed in the same manner as described above to use the empty oscillator ("TG5"in FIG. 20(6)) to produce a musical tone (steps S63 to 65). Then, the pointer is incremented by two (step S66), and program control returns from the tone production routine.

For ease of understanding the above described key assigner processing, an additional explanation will now be given for a table and the relationship between the movement of a pointer and tone-ON assignment, while referring to FIGS. 20 and 21.

At the reset time immediately following power on, as shown in FIG. 20(1) oscillators TG0 through TG7 (beginning with the lowest number) are arranged in numerical order, and a pointer is set to select oscillator pair TG0/TG1. All the oscillators at this time are set to the tone-OFF state.

When tone production for a two-source timbre is required, as shown in FIG. 20(2), tone generation is assigned to an oscillator pair designated by the pointer, i.e., to the oscillators TG0 and TG1, and the pointer is incremented by two.

When tone production for a two-source timbre is further required, as shown in FIG. 20(3), tone generation is again assigned to an oscillator pair designated by the pointer, i.e., to the oscillators TG2 and TG3, and the pointer is incremented by two.

When tone production for a one-source timbre is required at this time, a check is performed to determine whether or not there is an oscillator pair that has one entry that is in use. In this case, however, no oscillator pair satisfies the above requirement. As shown in FIG. 20(4), therefore, tone generation is assigned to oscillator TG4 of the oscillator pair TG4 and TG5, which is designated by the pointer, and the pointer is thereafter incremented by two. No tone generation data are assigned to the oscillator TG5.

Then, when tone production for a two-source timbre is required, as shown in FIG. 20(5), tone generation is assigned to an oscillator pair designated by the pointer, i.e., to oscillators TG6 and TG7, and the pointer is incremented by two. Thereafter, the pointer is reset to its initial value.

Under this condition, when tone generation for a one-source timbre is required, as shown in (6)(1) in FIG. 20, a check is performed to determine whether there is an oscillator pair in which only one entry is in use. This search begins with the entry pair that the pointer currently designates. Since in this case there exists an entry pair that satisfies the above requirement (oscillator TG5 is not in use), a sorting process is performed as shown in (6)(2) in FIG. 20.

In the sorting process, the original oscillator numbers in the positions designated by the pointer, and the other oscillator numbers that precede the selected oscillator pair, are repositioned, and the numbers of the selected oscillator pair are inserted into the positions designated by the pointer. Tone generation is then assigned to the unused oscillator TG5, and the pointer is incremented by two.

When tone generation for a two-source timbre is required, as shown in FIG. 21(7), musical tones that are produced by an oscillator pair designated by the pointer, i.e., the oscillators TG0 and TG1, are abruptly halted. Tone generation is then reassigned to the oscillators TG0 and TG1 and the pointer is incremented by two.

When all tone production is completed, as shown in FIG. 21(8), all the entries that are identified by an asterisk, "*," which represents a tone-ON state, are released, while the oscillator numbers and the pointer for the table are unchanged.

Under this condition, if tone generation for a one-source timbre is required four times in succession, as depicted in FIG. 20(9), tone generation is assigned to only one oscillator of an oscillator pair.

At this time, when tone generation for a two-source timbre is required, as shown in FIG. 21(10), a musical tone being produced by an oscillator designated by the pointer, i.e., the oscillator TG2, is abruptly halted. Tone generation is then reassigned to TG2 and TG3, and the pointer is incremented by two.

Under this condition, when tone generation for a one-source timbre is required, as shown in (11)(1) in FIG. 21, a check is performed to determine whether there is an oscillator pair that has only one entry that is in use. This search begins with the entry that the pointer currently designates. Since in this case there exists an entry that satisfies the above requirement (oscillator TG7 is the first found that is not in use), a sorting process is performed as shown in (6)(2) in FIG. 20.

In this case, however, since the location designated by the pointer, and the position of the unused oscillator are the same, no oscillator numbers are not shifted. Tone generation is then assigned to the unused oscillator TG7, and the pointer is incremented by two.

Accordingly, musical tones are produced as required, while tone assignment is performed in the above described manner.

Figure 14:
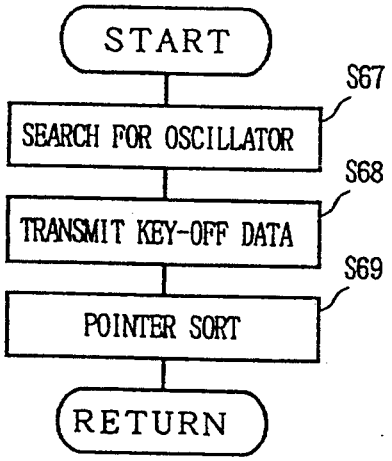
FIG. 14 is a flowchart showing a tone-OFF process according to the embodiment of the present invention.

A tone-OFF process will now be explained. In this process, as shown in FIG. 14, a search is performed to find the oscillator in the tone-ON state for which key-OFF data is intended (step S67).

Key-OFF data is then transmitted (step S68). Tone generation by the target oscillator is halted and tone generation is terminated.

Next, pointer sorting is performed (step S69). (Since the pointer sorting is the same as that described in step S62, an explanation for it will not be given here.) Thereafter, program control returns from the routine for the tone-OFF process.

As described above, by performing pointer sorting when tone generation is terminated, a search for an in use oscillator with which to produce a musical tone having a one-source timbre is simplified.

Figure 15:
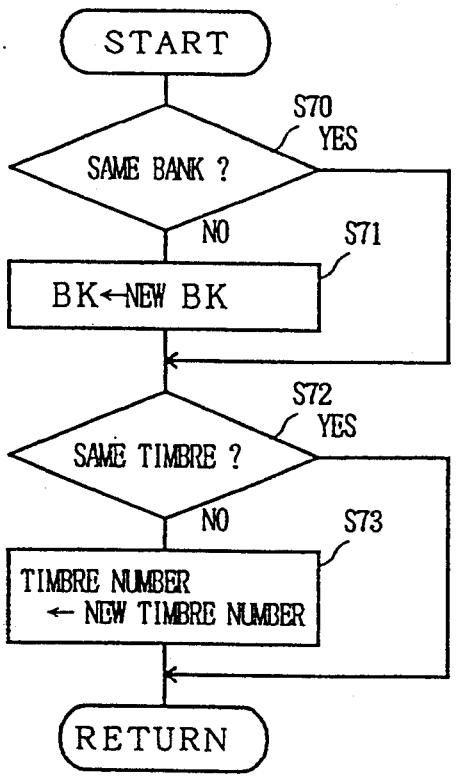
FIG. 15 is a flowchart showing a timbre change process according to the embodiment of the present invention.

A timbre change process will now be described. As is shown in FIG. 15, first, a check is performed to determine whether or not a timbre bank (new BK) that is included in the timbre select data is identical to the currently selected timbre bank (BK) (step S70). When they are not identical, the timbre bank (new BK) that is included in the timbre select data is selected for subsequent employment (step S71).

If, at step S70, the timbre banks are identical, program control skips step S71 and the timbre bank data are not altered.

Sequentially, a check is performed to determine whether or not a timbre identified by a timbre number included in the timbre select data (new timbre number) is identical to that of a currently selected timbre number (step S72). If the timbres identified by the timbre numbers are not identical, the timbre number included in the timbre select data is selected for subsequent employment (step S73). Program control then returns from the timbre change routine.

If, at step S72, the timbres identified by the timbre numbers are identical, program control skips step S73, and returns from the timbre change routine.

As described above, timbre data to be used for tone production are selected and a timbre is changed.

Pursuant to the foregoing description, according to this embodiment, a control unit is defined as an oscillator pair that is employed for the generation of a timbre. As long as there is one oscillator pair for which no task assignment has been effected for either oscillator, sequential control-unit task assignment to oscillators is performed, regardless of whether the assignment is for a one-source timbre or for a two-source timbre. Once oscillator assignment has been effected for each of the control units and a tone-ON command for a one-source timbre is received, the control units are examined to determine whether one of them includes an oscillator for which an assignment has not been effected. If one is found, tone production is assigned to that oscillator.

Therefore, since a two-source timbre assignment can be performed quickly, and as a one-source timbre can be assigned to an unoccupied oscillator included in an oscillator pair, the oscillators can be employed efficiently and the number of musical tones that can be simultaneously produced can be maximized.

The key assigner described in the above embodiment has been employed to explain the processing involved in the simultaneous production of musical tones having both one-source timbres, i.e., specific timbres generated by a single oscillator, and two-source timbres, i.e., specific timbres generated by two oscillators. The key assigner, however, can be employed with an electronic musical instrument that can generate timbres that require an arbitrary number of sources, while obtaining the same effect as in the embodiment.

As described above in detail, according to the present invention it is possible to provide a key assigner, for an electronic musical instrument, that can efficiently employ a limited number of oscillators, and that can maximize the number of musical tones that can be simultaneously produced without incurring an excessive time lapse between the reception of a tone-ON instruction and the actual tone production.

What is claimed is:

1. A key assigner for use in an electronic musical instrument having musical tone generating oscillators, said key assigner establishing the timbre characteristics of musical notes generated by the instrument in accordance with a timbre characteristic control signal calling for the use of a given maximum number of oscillators or a lesser number of oscillators in establishing the timbre characteristics, said key assigner comprising:

means establishing a predetermined plurality of sequentially accessible timbre characteristic control units, each of said control units comprising the maximum number of oscillators required for establishing a timbre characteristic; and control means responsive to a succession of timbre characteristic control signals for sequentially accessing said control units to operate said oscillators to produce musical tones, said control means employing in each said control unit only the number of oscillators called for by the timbre characteristic control signal for establishing the timbre characteristic for the produced musical tone, and when all of said control units are in use, said control means accessing said control units, responsive to timbre characteristic control signals calling for less than the number of oscillators comprising each control unit, to operate oscillators in said control units not then employed in the production of musical tones.

2. A key assigner according to claim 1 wherein each of said control units comprises a pair of oscillators.

3. A key assigner according to claim 1 wherein said control means comprises:

storage means containing indicia identifying said oscillators in said control units;

pointer means for designating, by control unit, an access sequence for said oscillator indicia in said storage means;

sorting means for sorting the contents of said storage means to permit said pointer means to designate an indicia for an oscillator not employed in tone production;

assigning means for assigning and operating an oscillator designated by said pointer means to produce a musical tone and timbre characteristic; and control means for said pointer means for shifting said pointer means in said access sequence after an assignment has been performed by said assigning means.

* * * * *